US009243827B2

(12) United States Patent
Kim et al.

(10) Patent No.: US 9,243,827 B2
(45) Date of Patent: Jan. 26, 2016

(54) CHILLER SYSTEM INCLUDING AN OIL SEPARATOR AND EJECTOR CONNECTION

(75) Inventors: Byeong Su Kim, Changwon-si (KR); Jun Hyeon Hwang, Changwon-si (KR); Beom Chan Kim, Changwon-si (KR); Sang Hoon Yoo, Changwon-si (KR); Jung Wook Moon, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 662 days.

(21) Appl. No.: 13/582,595

(22) PCT Filed: Jun. 10, 2010

(86) PCT No.: PCT/KR2010/003726

§ 371 (c)(1),
(2), (4) Date: Nov. 14, 2012

(87) PCT Pub. No.: WO2011/108780

PCT Pub. Date: Sep. 9, 2011

(65) Prior Publication Data

US 2013/0186128 A1 Jul. 25, 2013

(30) Foreign Application Priority Data

Mar. 5, 2010 (KR) ..... 10-2010-0019989

(51) Int. Cl.

| | |
|---|---|
| ***F25B 43/02*** | (2006.01) |
| ***F25B 31/00*** | (2006.01) |
| ***F25B 41/00*** | (2006.01) |

(52) U.S. Cl.

CPC ..... *F25B 43/02* (2013.01); *F25B 31/004* (2013.01); *F25B 41/00* (2013.01); *F25B 2341/0012* (2013.01)

(58) Field of Classification Search

CPC ..... F25B 2341/0012; F25B 31/004; F25B 2341/00; F25B 41/00; F25B 2341/0011; F25B 2341/0013; F25B 2341/0014; F25B 2341/0016; F25B 31/002

USPC ..... 62/470, 500, 84, 512, 513, 468, 515

See application file for complete search history.

(56) References Cited

U.S. PATENT DOCUMENTS

| | | | | |
|---|---|---|---|---|
| 6,182,467 | B1 * | 2/2001 | Zhong et al. | 62/470 |
| 2002/0162352 | A1 * | 11/2002 | Ring et al. | 62/471 |
| 2007/0000262 | A1 * | 1/2007 | Ikegami et al. | 62/170 |
| 2007/0245752 | A1 * | 10/2007 | Honda | 62/115 |

FOREIGN PATENT DOCUMENTS

| | | |
|---|---|---|
| KR | 10-0515527 | 9/2005 |
| KR | 10-0738555 | 7/2007 |
| KR | 10-2008-0038065 | 5/2008 |

* cited by examiner

*Primary Examiner* — Cheryl J Tyler
*Assistant Examiner* — Ana Vazquez
(74) *Attorney, Agent, or Firm* — Dentons US LLP

(57) ABSTRACT

A chiller system including an oil separator and ejector connection through which an oil is separated from a refrigerant discharged from a compressor at the oil separator, a portion of the refrigerant discharged from the compressor and an oil discharged from an evaporator are rejected by the ejector, and the separated oil and the ejected refrigerant and oil are heat exchanged, and return into the compressor.

10 Claims, 1 Drawing Sheet

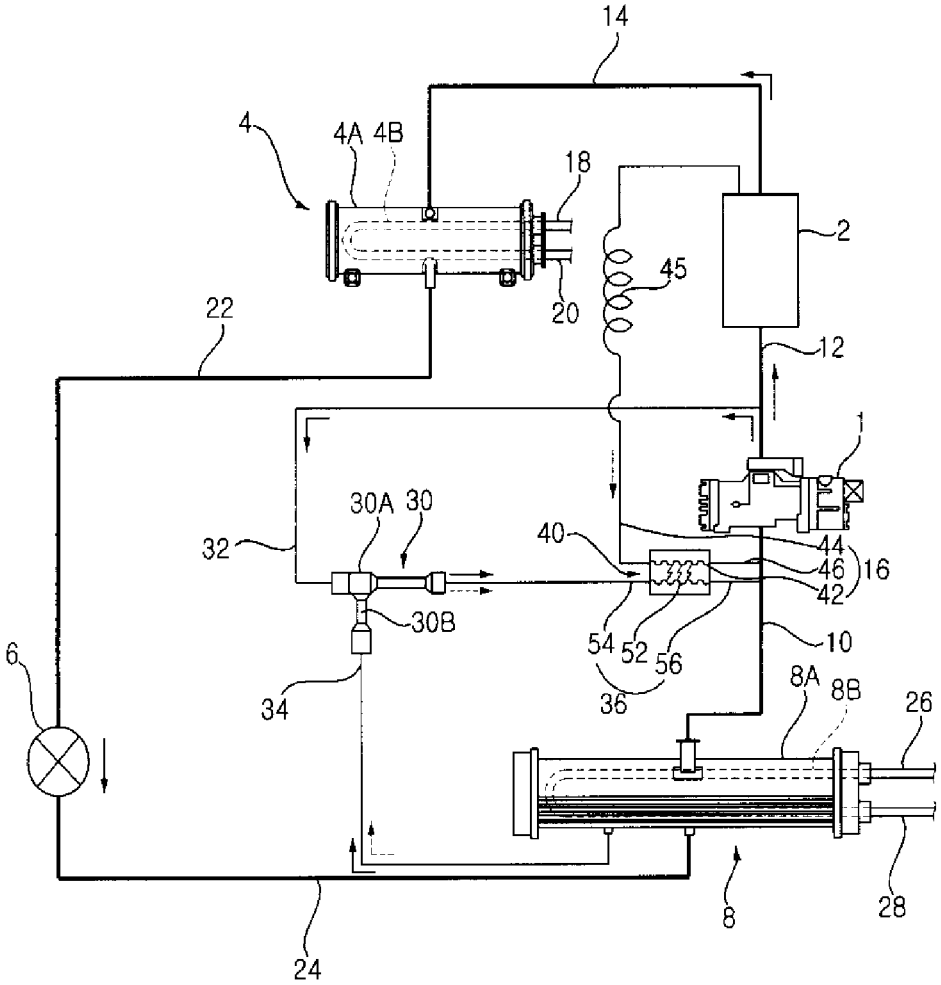
14
4
4A 4B
18
2
45
20
22
12
1
30A 30
32
40
44
46
16
42
30B
54 52 56
10
6
34
36
8A 8B
26
8
28
24

CHILLER SYSTEM INCLUDING AN OIL SEPARATOR AND EJECTOR CONNECTION

This application is a National Stage Entry of International Application No. PCT/KR2010/003726, filed Jun. 10, 2010, and claims the benefit of Korean Application No. 10-2010-0019989, filed on Mar. 5, 2010, each of which is hereby incorporated by reference for all purposes as if fully set forth herein.

TECHNICAL FIELD

The present invention relates to a chiller supplying cold water to demand sources of the cold water, particularly a chiller having an evaporator oil return channel through which oil in an evaporator turns to a compressor.

BACKGROUND ART

In general, chillers that supply cold water to demand sources of cold water such as an air conditioner or a freezer include a compressor, a condenser, an expander, and an evaporator, through which a refrigerant circulates.

The evaporator in chillers is implemented by a liquid refrigerant heat exchanger to allow heat exchange between a refrigerant and water (hereafter, referred to as cold water), is connected with demand sources of cold water through a water pipe, and circulates and supplies cold water cooled by the refrigerant to the demand sources of cold water.

In the chillers, oil is discharged with the refrigerant when the compressor is driven, and flows into the evaporator and collects therein, after sequentially passing through the condenser and the expander together with the refrigerant.

DISCLOSURE

Technical Problem

In a chiller according to the related art, when an evaporator oil return channel is connected to the evaporator, the oil and liquid refrigerant in the evaporator can return to the compressor through an evaporator oil return channel, in which when a large amount of liquid refrigerant is sucked into the compressor, the compressor is likely to be damaged and the compression efficiency is low.

The present invention has been made in an effort to solve the problems in the related art described above and it is an object of the present invention to provide a chiller that can prevent damage to a compressor and increase efficiency of the compressor.

Technical Solution

A chiller according to the present invention includes: a compressor compressing a refrigerant; an oil separator separating a refrigerant and oil discharged from the compressor; a condenser condensing the refrigerant that has passed through the oil separator; an expander expanding the refrigerant condensed by the condenser; an evaporator allowing the refrigerant expanded by the expander to cool cold water, and connected with a cold-water demand source by a cold water pipe; an ejector through which some of the refrigerant compressed by the compressor passes and that is connected with the evaporator by an evaporator oil return channel; an oil separator oil return channel connected such that the oil discharged from the oil separator passes and then returns to the compressor; and an ejector outlet channel connected such that the oil and the refrigerant discharged from the ejector returns to the compressor after passing, in which the oil separator oil return and the ejector outlet channel are disposed such that heat is exchanged.

The evaporator is a shell-type type of heat exchanger having: a shell that has a refrigerant inlet through which the refrigerant expanded by the expander is sucked and a refrigerant outlet through which the evaporated refrigerant is discharged, and is connected with the evaporator oil return channel; and an inner tube that is disposed in the shell and through which cold water flows.

The chiller includes a total heat exchanger including: a heat discharge channel through which the oil discharged from the oil separator passes; and a heat absorbing channel through which the oil and the refrigerant discharged from the ejector pass.

The chiller includes: an ejector-heat absorbing channel connection channel that connects the ejector with the heat absorbing channel; and a heat absorbing channel-intake pipe connection channel that connects the heat absorbing channel with the intake pipe of the compressor, in which the ejector-heat absorbing channel connection channel, the heat absorbing channel, and the heat absorbing channel-intake pipe connection channel constitute the ejector outlet channel.

The compressor and the oil separator are connected by a discharge pipe, and the ejector is connected with the discharge pipe by a discharge pipe-ejector connection channel.

The ejector includes: a main channel between the discharge pipe-ejector connection channel and the ejector outlet channel; and a join channel between the main channel and the evaporator oil return channel.

The chiller includes: an oil separator-heat discharge channel connection channel that connects the oil separator with the heat discharge channel; and a heat discharge channel-intake pipe connection channel that connects the heat discharge channel with the intake pipe of the compressor, in which the oil separator-heat discharge channel connection channel, the heat discharge channel, and the heat discharge channel-intake pipe connection channel constitute the oil separator oil return channel.

The total heat exchanger includes: an internal pipe where one of the heat discharge channel and the heat absorbing channel is formed; and an external pipe where the other one of the heat discharge channel and the heat absorbing channel is formed between the internal pipe and the external channel.

The heat discharge channel and the heat absorbing channel are alternately formed with a plurality of heat transfer members therebetween, in the total heat exchanger.

Advantageous Effects

The chiller having the configuration according to the present invention has the advantage of preventing damage to the compressor and increasing efficiency of the compressor, by decreasing high-temperature oil returning from the oil separator through the oil separator oil return channel and by evaporating the liquid refrigerant returning from the evaporator through the evaporator oil return channel.

Further, since the refrigerant sucked into the ejector to absorbing the oil in the evaporator into the ejector is the high-temperature and high-pressure gaseous refrigerant discharged from the compressor, the low-temperature liquid refrigerant and oil returning to the evaporator oil return channel from the evaporator increase in temperature by primarily exchanging heat with the high-temperature and high-pressure gaseous refrigerant in the ejector, and secondarily increase in temperature by exchanging heat with the high-temperature oil returning to the oil separator oil return channel in the total heat exchanger, such that there is the advantage of minimizing the possibility of sucking the liquid refrigerant into the compressor.

DESCRIPTION OF DRAWINGS

FIG. 1 is a configuration diagram of an embodiment of a chiller according to the present invention.

MODE FOR INVENTION

Exemplary embodiments of the present invention will be described hereafter in detail with reference to the accompanying drawings.

FIG. 1 is a configuration diagram of an embodiment of a chiller according to the present invention.

A chiller according to the present embodiment includes a compressor 1 compressing a refrigerant, an oil separator 2 separating a refrigerant and oil discharged from the compressor 1, a condenser 4 condensing the refrigerant that has passed through the oil separator 2, an expander 6 expanding the refrigerant condensed by the condenser 4, and an evaporator 8 allowing the refrigerant expanded by the expander 6 to cool cold water, and connected with a cold-water demand source by a cold water pipe.

The chiller is a part supplying cold water to a cold-water demand source and the cold-water demand source may be configured by a ventilation-compatible air-conditioning unit, a non-ventilating air-conditioning unit, a floor-heating unit, or the like.

When the cold-water demand source is configured by a ventilation-compatible air-conditioning unit, it is configured to suck the indoor air and the outdoor air, discharge some of the sucked indoor air to the outside, and mix the other indoor air with the outdoor air and then cool and supply the mixture to the room, in which the cold-water demand source may be include a cold water coil connected with the evaporator 8 by cold pipes 26 and 28 and having a cold water channel for cold water, and a fan that blows and circulates the air mixture of the indoor air and the outdoor air to the cold water coil.

When the cold-water demand source is configured by a non-ventilating air-conditioning unit, it is configured to sucks the indoor air and cools and supply the sucked indoor air, in which the cold-water demand source may be configured by an FCU (Fan Coil Unit) including a cold water coil connected with the evaporator 8 by cold pipes 26 and 28 and having a cold water channel for cold water, and a fan that blows and circulates the indoor air to the cold water coil.

When the cold-water demand source is configured by a floor-heating unit, it may be configured by a floor-heating pipe connected with the evaporator 8 by cold water pipes 26 and 28 and installed under the flower of a room.

The compressor 1 that is a component compressing the refrigerant evaporated by the evaporator 8 may be configured by one of a rotary compressor, a scroll compressor, and a screw compressor, may be configured such that the operation capacity is variable, and may be configured to compress the refrigerant in several steps.

The compressor 1 includes a compressing unit having a compression chamber where a refrigerant is compressed and a motor unit providing the compression unit with a driving force for compressing the refrigerant.

The compressor 1 contains oil for preventing damage to the motor unit and the compression unit and the oil is discharged with the refrigerant when the refrigerant is discharged.

For the compressor 1, an intake pipe 10 is connected with an evaporator 8 and the refrigerant evaporated by the evaporator 8 is sucked into the compressor 1 through the intake pipe 10, and a discharge pipe 12 is connected with the oil separator 2 and the refrigerant discharged from the compressor 1 flows into the oil separator 2 through the discharge pipe 12.

The oil separator 2 may be equipped with an oil separating member or a cyclone therein through which the refrigerant and the oil are separated.

An oil separator-condenser connection pipe 14 that allows the refrigerant discharged from the oil separator 2 to flow to the condenser 4 is connected to the oil separator 2 while an oil separator oil return channel 16 through which the oil discharged from the oil separator 2 returns to the compressor 1.

The oil separator 2 fails to completely separate the refrigerant and the oil and some of the oil flows to the condenser 4 through the oil separator-condenser connection pipe 14.

The oil separator 2 allows some of a gaseous refrigerant to flow to the intake pipe 10 of the compressor 1 through the oil separator oil return channel 16 and the fluid mixture of the oil and the gaseous refrigerant that pass through the oil separator oil return channel 16 is referred as oil in the following description.

The oil separator oil return channel 16 is a bypass channel that allows the oil separated by the oil separator 2 to bypass the condenser 4, the expander 6, and the evaporator 8.

The oil separator oil return channel 16 has one end connected to the oil separator 2 and the other end connected to the intake pipe 10, and the oil separator oil return channel 16 is described in detail below.

The condenser 4 that is a part condensing the refrigerant compressed by the compressor 1 may be configured by a shell-tube type of heat exchanger or may also be configured by a fin-tube type of heat exchanger.

When the condenser 4 is configured by a shell-tube type of heat exchanger, a condensing space where the refrigerant can be condensed is defined in a shell 4A, a coolant tube 4B through which a coolant passes is disposed in the condensing space, and the coolant tube 4B is connected with a demand source (not shown) such as a cooling top by coolant pipes 18 and 20, such that the refrigerant is condensed by exchanging heat with a coolant while passing through the shell 4A.

When the condenser 4 is configured by a fin-tube type of heat exchanger, a condensing fan installed around the condenser 4 supplies cold air such as the external air to the condenser 4 and the refrigerant passing through the tube is condensed by exchanging heat with cold water such as the external air.

The condenser 4 is connected with the expander 6 by a condenser-expander connection pipe 22.

The expander 6 that is a part expanding the refrigerant condensed by the condenser 4 is configured by a capillary tube or an EEV (Electronic Expansion Valve).

The evaporator 8 that is a part evaporating the refrigerant expanded by the expander 6 is connected with the expander 6 by an expander-evaporator connection pipe 24.

The evaporator 8 is configured by a shell-tube type of heat exchanger and the refrigerant flowing into the evaporator 8 is evaporated in the evaporator 8 and sucked into the compressor intake pipe 10.

The evaporator 8 is connected with a demand source of cold water by cold water pipes 26 and 28 and cold water cools the demand source of cold water while circulating through the cold water pipe 26, the evaporator 8, the cold water pipe 28, and the demand source of cold water.

The evaporator 8 includes a shell 8A and an inner tube 8A disposed in the shell 8A.

The shell 8A has an evaporation space where the refrigerant is evaporated, a refrigerant inlet through which the refrigerant expanded by the expander 6 is sucked, and a refrigerant outlet through which the evaporated refrigerant is discharged to the intake pipe 10.

The inner tube 8B is disposed in the shell 8A and connected with the cold water pipes 26 and 28 such that cold water flows.

When the chiller operates, the oil that is not separated by the oil separator 2 flows into the evaporator 8 after sequentially passing through the condenser 4 and the expander 6 together with the refrigerant and the oil flowing in the evaporator 8 is positioned above a liquid refrigerant in the evaporator 8 or positioned in an oil passage separately divided from the evaporation space in the evaporator 8.

The chiller further includes an ejector 30 that forces the oil to flow to the intake side of the compressor.

The ejector 30 is installed such that some of the refrigerant compressed by the compressor 1 passes and the oil of the evaporator 8 passes.

The ejector 30 is connected with the discharge pipe 12 of the compressor 1 by a discharge pipe-ejector connection channel 32 and connected with the evaporator 8 by an evaporator oil return channel 34.

The discharge pipe-ejector connection channel 32 has one end connected to the discharge pipe 12 of the compressor 1 and the other end connected to the ejector 30.

The evaporator oil return channel 34 has one end connected to the shell 8A of the evaporator 8 and the other end connected to a join channel of the ejector 30 which is described below.

An ejector outlet channel 36 through which the oil and the refrigerant discharged from the ejector 30 returns to the compressor 1.

The ejector outlet channel 36 has one end connected to the outlet of the ejector 30 and the other end connected to the intake pipe 10 of the compressor 1.

The ejector 30 has a main channel 30A between the discharge pipe-ejector connection channel 32 and the ejector outlet channel 36, and a join channel 30B between the main channel 30A and the evaporator oil return channel 34.

The ejector 30 is implemented by a vacuum ejector of which the entire shape is a T-shape.

In the ejector 30, the refrigerant flowing to the main channel 30A through the discharge pipe-ejector connection channel 32 is discharged to the ejector outlet channel 36 after passing through a narrow pipe portion of the main channel 30A, in which an suction force is generated at the join channel 30B and the evaporator oil return channel 34, and the oil and the liquid refrigerant in the evaporator 8 flows to the main channel 30A after sequentially passing the evaporator oil return channel 34 and the join channel 30B by the suction force.

In the chiller, the oil and the liquid refrigerant sucked in the ejector 30 through the evaporator oil return channel 34 from the evaporator 8 exchange heat with the oil flowing to the oil separator oil return channel 16 from the oil separator 2 while passing through the ejector outlet channel 36.

That is, the oil separator oil return channel 16 and the ejector outlet channel 36 are disposed such that heat exchange is performed.

High-temperature oil discharged from the oil separator 2 flows through the oil separator oil return channel 16, the low-temperature oil and liquid refrigerant sucked from the evaporator flow through the ejector outlet channel 36, and the high-temperature oil passing through the oil separator oil return channel 16 exchanges heat with the low-temperature oil passing through the ejector outlet channel 36. That is, the oil in the oil separator oil return channel 16 decreases in temperature, and the oil and the refrigerant in the ejector outlet channel 36 increases in temperature.

The oil in the oil separator oil return channel 16 decreases in temperature while the heat is taken to the oil and the refrigerant in the ejector outlet channel 36, in which viscosity of the oil passing through the oil separator oil return channel 16 gradually decreases by the decrease in temperature.

Further, since the oil passing through the oil separator oil return channel 16 is sucked into the compressor 1 after decreasing in temperature, the internal temperature of the compressor 1 does not increase above a necessary level and reduction of efficiency generated when high-temperature oil is sucked into the compressor is minimized Meanwhile, the oil and the liquid refrigerant in the ejector outlet channel 36 increase in temperature while taking the hat of the oil in the oil separator oil return channel 16, in which the liquid refrigerant is sucked into the compressor 1 after vaporizing due to the increase in temperature, such that the liquid refrigerant sucked into the compressor 1 may be minimized or only oil and a gaseous refrigerant are sucked into the compressor 1.

That is, reduction of efficiency and damage to the compressor which are generated when the liquid refrigerant is sucked into the compressor 1 are minimized In the chiller, the oil separator oil return channel 16 and the ejector outlet channel 36 each may be configured by a pipe and the two pipes may be at least partially in contact with each other such that heat is exchanged.

The chiller may be equipped with a total heat exchanger, and a portion of the oil separator oil return channel 16 (hereafter, heat discharge channel) and a portion of the ejector outlet channel 36 (hereafter, heat absorbing channel) may be formed at the total heat exchanger.

It is assumed in the following description that a total heat exchanger 40 with separate heat discharge channel and heat absorbing channel is installed.

The total heat exchanger 40 has a heat discharge channel 42 through which the oil discharged from the oil separator 2 passes and a heat absorbing channel 52 through which the oil and the refrigerant discharged from the ejector 30 pass.

The total heat exchanger 40 may include an internal pipe where one of the heat discharge channel 42 and the heat absorbing channel 52 is formed and an external pipe where the other one of the heat discharge channel 42 and the heat absorbing channel 52 is formed between the internal pipe and the external pipe, and the heat discharge channel 42 and the heat absorbing channel 52 may be alternately formed with a heat transfer member.

The chiller includes an oil separator-heat discharge channel connection channel 44 connecting the oil separator 2 with the heat discharge channel 42 and a heat discharge channel-heat absorbing channel connection channel 46 connecting the heat discharge channel 42 with the intake pipe 10 of the compressor 1.

In this configuration, the oil separator-heat discharge channel connection channel 44 includes a capillary tube 45.

That is, the oil separator oil return channel 16 includes the oil separator-heat discharge channel connection channel 44 and the heat discharge channel-heat absorbing channel connection channel 46.

The chiller according to the present embodiment includes an oil ejector-heat absorbing channel connection channel 54 connecting the ejector 30 with the heat absorbing channel 52 and a heat absorbing channel-intake pipe connection channel 56 connecting the heat absorbing channel 52 with the intake pipe 10 of the compressor 1.

That is, the ejector outlet channel 36 includes the oil ejector-heat absorbing channel connection channel 54 and the heat absorbing channel-intake pipe connection channel 56.

The operation of the present invention having the configuration described above is described hereafter.

First, when the compressor 1 is driven, a high-temperature and high-pressure gaseous refrigerant is discharged from the compressor 1, in which the oil in the compressor is discharged with the high-temperature and high-pressure gaseous refrigerant to the discharge pipe 12.

The refrigerant and oil discharged to the discharge pipe 12 are separated through the oil separator 2, the high-temperature and high-pressure gaseous refrigerant and oil not separated by the oil separator 2 flow to the oil separator-condenser connection pipe 14, and the high-temperature and high-pressure gaseous refrigerant flows with oil to the condenser 4.

The refrigerant flowing in the condenser 4 is condensed by exchanging heat with cold water, and flows with the oil to the expander and is then expanded by the expander 6.

The refrigerant expanded by the expander 6 flows with the oil to the evaporator 8, the refrigerant in the refrigerant and oil flowing to the evaporator 8 is sucked to the compressor 1 through the intake pipe 10 of the compressor 1 after evaporating by exchanging heat with the cold water in the evaporator 8, and the oil remains in the evaporator 8.

When the refrigerant circulates, as described above, the oil is sucked into the intake pipe 10 of the compressor, after sequentially passing through the oil separator-heat discharge channel connection channel 44, the heat discharge channel 44, and the heat discharge channel-intake pipe connection channel 46, which constitute the oil separator oil return channel 16.

Further, some of the high-temperature and high-pressure gaseous refrigerant discharged from the compressor 1 flows to the ejector-heat absorbing channel connection channel 54 through ejector 30 at a high speed after passing through the discharge pipe-ejector connection channel 32, and some of the liquid refrigerant and oil in the evaporator 8 is sucked into the ejector 30 and flow to the ejector-heat absorbing channel connection channel 54 after passing through the evaporator oil return channel 34 by the suction force generated by the ejector 30.

The oil and refrigerant flowing to the ejector-heat absorbing channel connection channel 54 are sucked into the intake pipe 10 of the compressor 1 after sequentially passing through the heat absorbing channel 52 and the heat absorbing channel-intake pipe connection channel 56.

Meanwhile, in the total heat exchanger 40, the oil passing through the heat discharge channel 42 decreases in viscosity while decreasing temperature and the oil decreased in temperature through the heat discharge channel 42 is sucked into the intake pipe 10 of the compressor 1.

Further, the liquid refrigerant and oil passing through the heat absorbing channel 52 increase in temperature and the liquid refrigerant evaporates, and the oil and gaseous refrigerant increased in temperature through the heat absorbing channel 52 is sucked into the intake pipe 10 of the compressor 1.

That is, the gaseous refrigerant evaporated and the oil decreased in viscosity through the heat absorbing channel are sucked into the compressor 1, such that damage to the compressor 1 is minimized and efficiency of the compressor 1 increases.

The invention claimed is:

1. A chiller system including an oil separator and ejector connection comprising: a compressor compressing a refrigerant; an oil separator separating the refrigerant and an oil discharged from the compressor; a condenser condensing the refrigerant that has passed through the oil separator; an expander expanding the refrigerant condensed by the condenser; an evaporator allowing the refrigerant expanded by the expander to cool cold water, and connected with a cold-water demand source by a cold water pipe; an ejector connected with the compressor by a discharge pipe-ejector connection channel and connected with the evaporator by an evaporator oil return channel such that a portion of the refrigerant discharged from the compressor and an oil discharged from the evaporator are ejected thereby; an oil separator oil return channel connected between the oil separator and the compressor such that the oil discharged from the oil separator passes and then returns to the compressor; and an ejector outlet channel connected between the ejector and the compressor such that the oil and the refrigerant discharged from the ejector returns to the compressor, wherein the oil separator oil return channel and the ejector outlet channel are disposed such that the oil discharged from the oil separator and the oil and the refrigerant ejected from the ejector are heat-exchanged.

2. The chiller of claim 1, wherein the evaporator is a shell-type type of heat exchanger having:

a shell that has a refrigerant inlet through which the refrigerant expanded by the expander is sucked and a refrigerant outlet through which the evaporated refrigerant is discharged, and is connected with the evaporator oil return channel; and an inner tube that is disposed in the shell and through which cold water flows.

3. The chiller of claim 1, comprising a total heat exchanger including:

a heat discharge channel through which the oil discharged from the oil separator passes; and a heat absorbing channel through which the oil and the refrigerant discharged from the ejector pass.

4. The chiller of claim 3, comprising:

an ejector-heat absorbing channel connection channel that connects the ejector with the heat absorbing channel; and a heat absorbing channel-intake pipe connection channel that connects the heat absorbing channel with an intake pipe of the compressor, wherein the ejector-heat absorbing channel connection channel, the heat absorbing channel, and the heat absorbing channel-intake pipe connection channel constitute the ejector outlet channel.

5. The chiller of claim 4, wherein the compressor and the oil separator are connected by a discharge pipe, and the ejector is connected with the discharge pipe by a discharge pipe-ejector connection channel.

6. The chiller of claim 5, wherein the ejector includes:

a main channel between the discharge pipe-ejector connection channel and the ejector outlet channel; and a join channel between the main channel and the evaporator oil return channel.

7. The chiller of claim 4, comprising:

an oil separator-heat discharge channel connection channel that connects the oil separator with the heat discharge channel; and a heat discharge channel-intake pipe connection channel that connects the heat discharge channel with the intake pipe of the compressor, wherein the oil separator-heat discharge channel connection channel, the heat discharge channel, and the heat discharge channel-intake pipe connection channel constitute the oil separator oil return channel.

8. The chiller of claim 3, comprising:

an oil separator-heat discharge channel connection channel that connects the oil separator with the heat discharge channel; and a heat discharge channel-intake pipe connection channel that connects the heat discharge channel with the intake pipe of the compressor, wherein the oil separator-heat discharge channel connection channel, the heat discharge channel, and the heat discharge channel-intake pipe connection channel constitute the oil separator oil return channel.

9. The chiller of claim 1, wherein a total heat exchanger includes:

an internal pipe where one of a heat discharge channel and a heat absorbing channel is formed; and an external pipe where the other one of the heat discharge channel and the heat absorbing channel is formed, positioned externally with respect to the internal pipe.

10. The chiller of claim 1, wherein a heat discharge channel and a heat absorbing channel are alternately formed with a plurality of heat transfer members between the heat discharge channel and the heat absorbing channel, in a total heat exchanger.

* * * * *